US005904112A

United States Patent [19]

Tylaska et al.

[11] Patent Number: 5,904,112

[45] Date of Patent: May 18, 1999

[54] SHACKLE APPARATUS

[76] Inventors: Timothy T. Tylaska, 138 N. Stonington Rd., Mystic, Conn. 06355; Gregory R. Kline, 10 Sunset Ave., Ledyard, Conn. 06339; Gregory C. Moore, 17 Quakertown Rd., Mystic, Conn. 06355

[21] Appl. No.: 09/110,184

[22] Filed: Feb. 23, 1998

Related U.S. Application Data

[63] Continuation-in-part of application No. 08/856,258, May 14, 1997, abandoned.

[51] Int. Cl.[6] ..... B63H 9/04

[52] U.S. Cl. ..... 114/108; 24/602

[58] Field of Search ..... 114/39.1, 102, 114/108, 113, 109, 1.4; 24/599.5, 600.2, 601.5, 602, 607, 609, 375; 294/82.34; 59/3

[56] References Cited

U.S. PATENT DOCUMENTS

| | | | |
|---|---|---|---|
| 2,764,792 | 10/1956 | Mansfield | 24/375 |
| 3,850,468 | 11/1974 | Hultin | 294/82.34 |
| 4,590,882 | 5/1986 | Murphy | 114/108 |
| 5,195,223 | 3/1993 | Tylaska | 24/602 |
| 5,634,246 | 6/1997 | Jermyn, Jr. | 24/601.5 |

*Primary Examiner*—Stephen Avila

[57] ABSTRACT

An improved shackle apparatus that introduces improvements to the basic shackle design to allow for easy attachment to the corner of a flexible membrane such as a sail. The releasable shackle comprises of a body, hook, internal trigger, and mounting lugs. The mounting lugs are located on the shackle body such that the shackle can be attached to the corner of a sail using standard webbing and eliminates the need to install an additional grommet or ring onto the sail. The lugs are oriented such as to position the pivot point of the shackle hook at the projected comer of the sail, or alternatively slightly below the bottom edge of the sail to prevent the foot of the sail from dragging over the deck when connected to a standard deck fitting. The lugs are also arranged in such a manner as to position the pivot point of the shackle hook direct in line with the force vector created by loads on the sail so as to reduce the twisting moment on the shackle body and loadings on the hook and prevent the formation of wrinkles and creases across the sail fabric.

17 Claims, 5 Drawing Sheets

SHACKLE APPARATUS

This application is a continuation-in-part of U.S. patent application Ser. No. 08/856,258, filed on May 14, 1997 now abandoned.

BACKGROUND OF INVENTION

1. Field of the Invention

The invention relates to a shackle which can be attached to the corner of a flexible membrane such as a sail.

2. Description of the Related Art

In many applications, including the field of sailing, it is desired to attach the comer of a flexible membrane, hereafter referred to as a sail, to a line or fixed anchor point. A variety of attachment techniques have been introduced for attaching lines to points of attachment. For instance, U.S. Pat. No. 3,850,468, issued to Hultin on Nov. 26,1974, discloses a chain-like articulation permitting a more direct load between the attaching rope and its point of attachment. Common attachment techniques such as a knot, clip, or other type of existing connecting link, introduce many other undesirable traits to the characteristics of the sail.

U.S. Pat. No. 5,195,223 issued to Tylaska on Mar. 23, 1993, discloses a quick release mechanism which has a required triggering force that remains constant, regardless of the tension being constrained. This invention teaches an equation which yields a logarithmic spiral solution set that provides the configuration necessary to achieve this objective. Tylaska's '223 patent addresses only the problem of quick release and does not consider the specialized problems associated with attaching a sail to a line or anchor point.

Currently, the state of the art is to punch a hole through the corner of the sail and install a grommet, or sew a ring onto the comer of the sail. This ring or grommet is then used to loop through an attachment link such as a standard shackle or D ring. A punched hole or grommet must be located some distance inside from the true projection of the sail corner to provide for enough structural support. Because this grommet is located inward from the corner of the sail, the use of a standard shackle or D ring as an attachment link tends to pull the foot of the sail too far down toward the deck, causing the sail to drag across the surface of the deck unless a different roach cut is performed. The use of a ring tends to hold the foot of the sail too far above the deck, causing wind to seep under. A shackle apparatus that can be used to attach a sail to a line or anchor point that overcomes the shortcomings of using a punched hole, grommet or ring is not disclosed in the prior art.

SUMMARY OF THE INVENTION

It is an aspect of the invention to provide an improved shackle apparatus that overcomes the deficiencies of the prior art shackle designs.

It is another aspect of the invention to provide an improved shackle apparatus that eliminates the need to punch a hole and sew a grommet into the corner of a sail or attach a ring to the corner of the sail for attachment purposes.

It is another aspect of the invention to provide an improved shackle apparatus that reduces the unsupported strip of fabric between the attachment point and the edges of the sail.

It is another aspect of the invention to provide an improved shackle apparatus that connects to the corner of a sail such that the pivot point of the shackle hook lies at the projected corner of the sail or alternatively, lies slightly beyond the corner of the sail, and positions the bottom edge of the sail high enough above the deck that the sail does not drag.

It is another aspect of the invention to provide an improved shackle apparatus that eliminates the need of a grommet or ring for attachment purposes.

It is another aspect of the invention to provide an improved shackle apparatus that eliminates the formation of wrinkles or creases across the surface of a sail.

It is another aspect of the invention to provide an improved shackle apparatus that is attachable to a sail in such an orientation that the resultant force vector created by loads from the sail pulls directly through the centerline of the shackle connection, thus reducing the twisting moment exerted to the shackle body or loading on the shackle hook.

It is another aspect of the invention to provide an improved shackle apparatus that contains mounting lugs so that it can be easily attached to the corner of a sail with the use of standard strapping and webbing.

It is another aspect of the invention to provide an improved shackle apparatus that contains mounting lugs for attachment to the sail such that the shackle will not twist or slip with respect to the attaching straps or webbing when subject to a load or moment.

It is another aspect of the invention to provide an improved shackle apparatus that contains mounting lugs oriented in such a manner that the forces exerted by the attaching straps or webbing are spread equally among each lug.

It is another aspect of the invention to provide an improved shackle apparatus that comprises a geometry such that the shackle fits cleanly into the corner of a sail with a minimum of overlap or cutting of material.

It is another aspect of the invention to make the shackle an integral part of the sail so that the entire sail/shackle assembly is one self-contained unit.

It is a final aspect of the invention to provide an improved shackle apparatus that can be operated with the use of only one hand.

The invention is a shackle that can be attached to the corner of a flexible membrane. A shackle casing having a hook opening, a finger opening, and a trigger opening is provided. A hook having a pivotal end and a locking end with said pivotal end being pivotally connected within the hook opening of said shackle casing is provided. A hook pin within the pivotal end of said hook is provided. The hook pin is connected to the shackle casing. The hook pin defines a centerline. A trigger, having a locking end and a pivotal end is provided. The trigger is positioned within the finger opening with its pivotal end being pivotally connected within the trigger opening of said shackle casing. A shank is provided. The shank is rigidly attached to the shackle casing. The shank has a spring opening therethrough such that the spring opening communicates with the finger opening of said shackle casing. A plurality of attachment members located around the perimeter of the shackle casing is provided, wherein a flexible membrane can be attached thereto, and wherein said flexible membrane exerts a loading force on said attachment members. A spring is provided and is positioned within the spring opening of said shank such that said spring is urged against said trigger; so that when a user urges the locking end of said hook against the locking end of said trigger, said spring is compressed allowing the locking end of said hook to engage the locking end of said trigger until said shackle locks in a closed condition. When the user pulls on said trigger to compress said spring, the locking end of the hook is released from the locking end of the trigger to place said shackle in an open condition. The attachment members are positioned such that the loading force on each of said attachment members is substantially equal to one another.

DETAILED DESCRIPTION OF THE INVENTION

Figure 1:
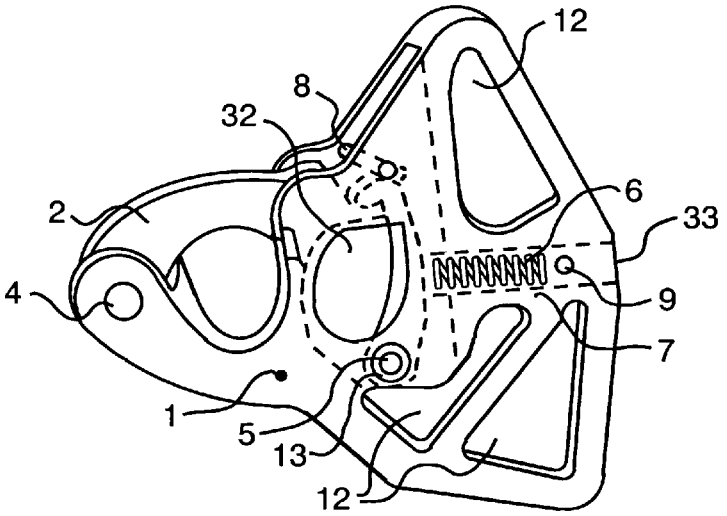
FIG. 1 is an isometric view of the completed shackle

In the utilization of attaching a sail to a line or anchor point, it is desirable to have an apparatus which can be securely attached to the comer of a sail with a minimum of effort, weight and effect to the aerodynamic properties of the sail. This apparatus must be attached in such a manner as to avoid creases, wrinkles or flapping of the fabric when under tension, and must also position the bottom edge of the sail at the correct height above the boat's deck. Furthermore, the apparatus should be releasable under tension, operable with one hand and contain no sharp edges or protrusions which may tear the sail's fabric. One such shortcoming of existing shackles or other types of attachment links is the difficulty in positioning the foot of the sail at the desired height above the surface of the boat's deck.

It is desirable to hold the foot of the sail at some point just above the deck. This positioning is not easily obtainable using the current configuration. It is desirable to implement both the attachment link and connection point to the sail into one self-contained apparatus to carefully control this positioning.

Another disadvantage of existing attachment apparatus is the expense and weight of using both the attachment link and ring or punched hole. A reinforcing grommet is needed through a punched hole in the sail to avoid tearing or fretting of the fabric. The installation of such a grommet is labor intensive and requires extensive reinforcing of the fabric around the grommet to ensure that it does not pull through. The installation of a ring is also labor intensive. Both the ring and the grommet add undesirable weight to the sail. It is desirable to implement an attachment apparatus which reduces this installation labor and weight of current state of the art attachment devices.

Another disadvantage of the punched hole in particular is that a thin strip of material located between the edge of this hole and extending outward along both edges of the sail becomes unsupported and subject to wrinkling, twisting and flapping. To minimize this unsupported edge, it is desirable to make such connection at the extreme comer of the sail. For some sail configurations, it is optionally desirable to extend the connection point just beyond the comer of the sail. With a punched hole, such support is not so easily obtained.

Another shortcoming of existing attachment apparatus involves the formation of creases and wrinkles which extend across the surface of the sail and disrupt the aerodynamic properties. If any rigid connection is made between a sail and an anchor point, it is crucial that such connection be oriented such that the resultant force vector created by the loads from the sail pulls directly through the centerline of the connection. Otherwise, a twisting moment may be present on the connection, creating a crease or wrinkle across the sail.

Another shortcoming of existing attachment apparatus is the inability to easily attach such apparatus to the comer of the sail with the use of standard materials such as strapping or webbing. Existing attachment apparatus, such as the common shackle or D ring, do not provide the installer with any suitable lugs through which standard webbing can be passed through and attached to the sail. As a result, the attaching of such apparatus requires extensive lashing and stitching. Furthermore, the apparatus tends to slip underneath such lashings and rotate when subject to a twisting moment.

Another shortcoming of existing attachment apparatus is that the forces exerted on the various straps and webs used to lash such an attachment device to a sail are not spread equally among each individual strap or web. As a result, if an ordinary attachment apparatus, such as a common shackle or D ring, were lashed to a flexible sheet, some areas of the lashing may be subject to greater stress than others, resulting in a decrease in strength of the overall connection. The connection is also subject to bunching up of the webbing, sharp edges of the connecting link, and lashing points in inappropriate spots of the sail.

Furthermore many existing attachment apparatus do not posses a smooth and snag free exterior. Many attachment apparatus, such as the common shackle, contain outside protrusions which tend to snag and tear the fabric of the sail when it is handled or when it is subject to the flogging and whipping actions from the wind.

Another shortcoming of existing attachment apparatus is the inability of releasing or attaching such apparatus with only one hand to accomplish the task. Existing attachment apparatus requires the use of two hands to effectively operate. In the field of sailing, it is desirable to use only one hand for such tasks, as the other hand is needed for balance and support.

FIG. 1 is an isometric view of the improved shackle apparatus 27 in its assembled configuration that solves the above-mentioned shortcoming experienced with present methods of attachment. All components are constructed from stainless steel, although other types of durable materials would be equally acceptable. The surfaces are highly polished to resist corrosion and all comers are rounded to eliminate sharp edges. The present invention incorporates several improvements upon those of a basic shackle, as are discussed in the following text.

Shackle 27 consists of casing 1 which utilizes mounting lugs 12, exposed hook 2 and internal trigger 3. Hook 2 is attached to shackle casing 1 by hook pivot pin 4, and internal trigger 3 is attached to shackle casing 1 by trigger pivot pin 5. Stop pin 8 is attached to casing 1 and acts as a mechanical stop for internal trigger 3. Spring 6 is placed behind internal trigger 3 and is partially housed in shank 7. Cross pin 9 is pressed through shank 7 and acts as a retainer for spring 6. The invention consists of a casing 1 containing an exposed hook 2 and an internal trigger 3.

Figure 2:
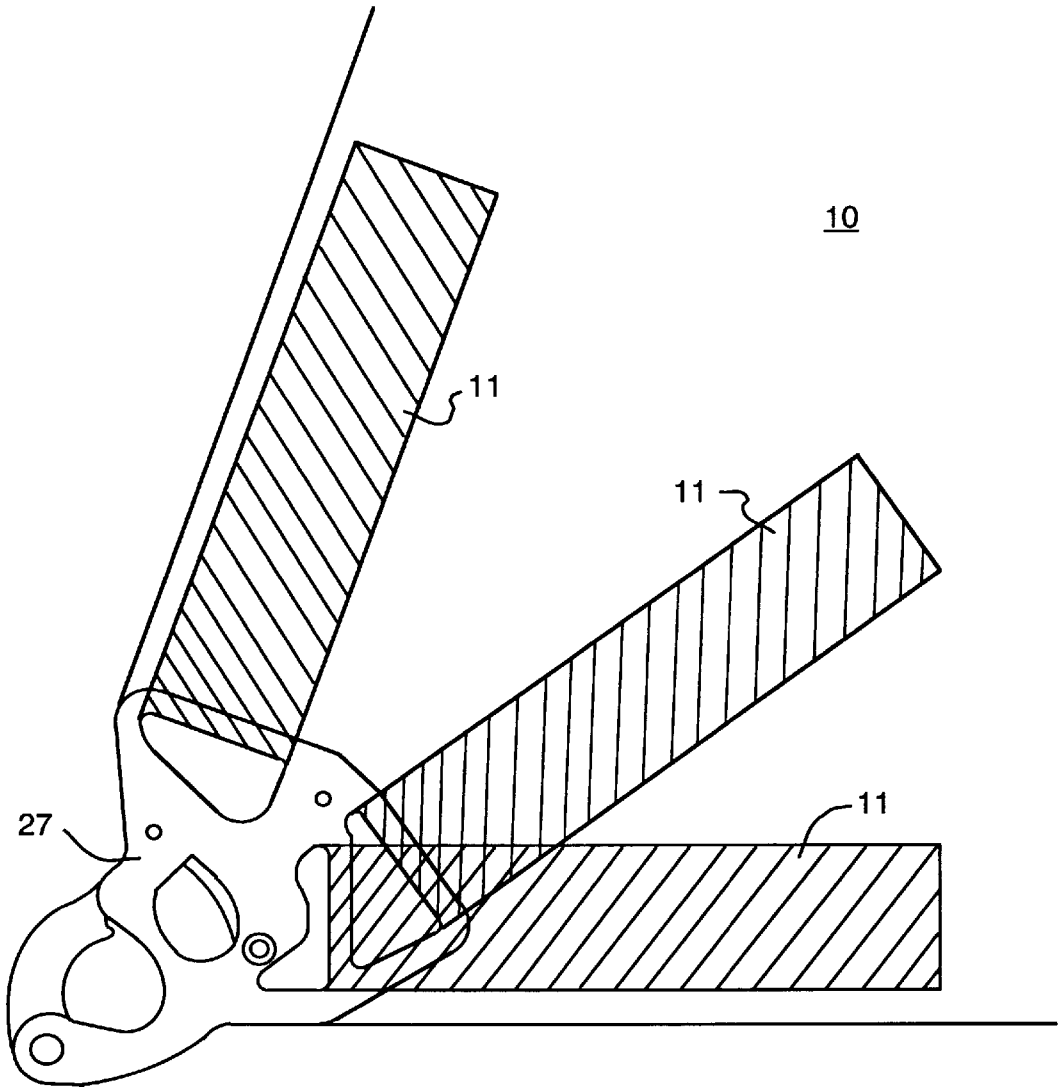
FIG. 2 is a side view of the shackle as attached to a sail or flexible membrane.

FIG. 2 is a side view of the shackle apparatus 27 as attached to a sail. The shackle 27 can be attached to the sail 10 by webbing 11 which is looped through lugs 12 and sewed onto sail 10. The lugs 12 are positioned on case 1 in such a manner that the loadings on each webbing strap 11 are of approximately the same value. Lugs 12 are also oriented on case 1 at such angles that the resultant force vector 28, created by the combination of wind force, halyard tension and foot tension against sail 10, passes basically through the center of line of hook pivot pin 4 to minimize any twisting moment on shackle 27 and provide proper orientation for release. The layout of lugs 12 is also of such a geometry as to fit cleanly into the corner of sail 10 with a minimum of cutting into the sail and also such that it spreads out the webbing to distribute the load evenly over the sail comer. Lugs 12 are also placed on the rear of case 1 so that the hook pivot pin 4 is located at the projected corner of sail 10. Alternately, lugs 12 can be placed on the rear case 1 so that hook pivot pin 4 is located outside of and below the corner of sail 10 to lift the foot 29 of sail 10 up above boat deck 30 when attached to standard deck fitting 31. Lugs 12 can optionally be arranged in other geometries and variations, or replaced with other attachment devices dependent upon the particular application.

Figure 3:
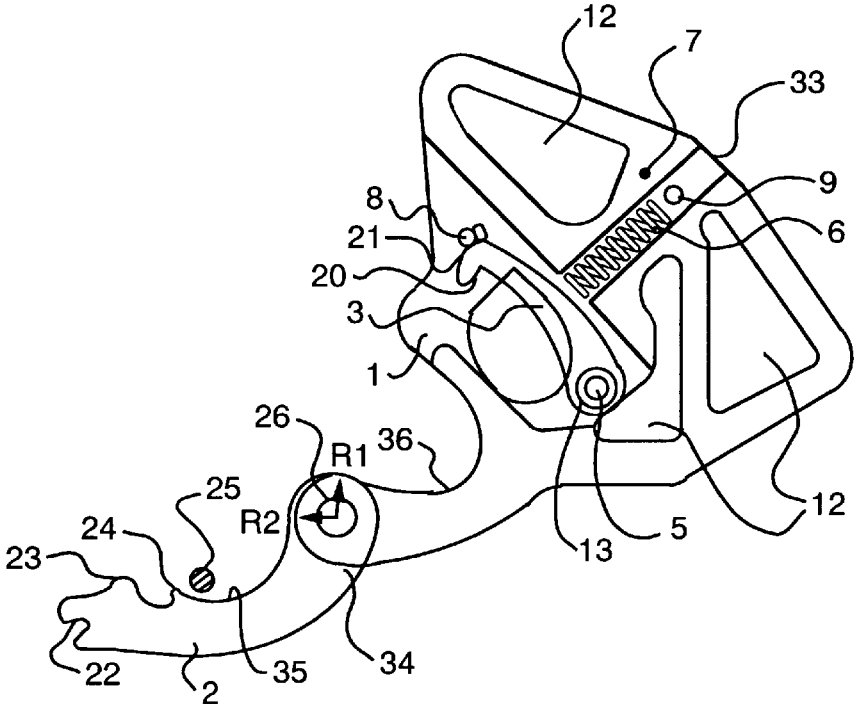
FIG. 3 is a side view of the completed shackle.

FIG. 3 shows a side view of shackle apparatus 27. The casing 1 contains a trigger finger hole 32. The casing also contains raised bosses 13 to provide greater structural strength for casing 1 and greater bearing area for pin 5. The faces and comers of lugs 12 are well rounded to prevent cutting or chafing of webbing 11. When closing hook 2, the end of hook 2 contacts the sloped trigger surface 21, forcing trigger 3 backward. Surface 22 of hook 2 then snaps under surface 20 of trigger 3, locking hook 3 in a closed position.

Figure 4:
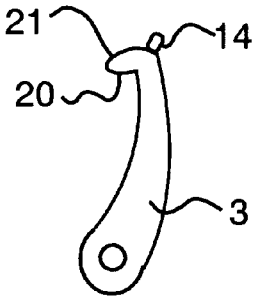
FIG. 4 is a side view of the shackle trigger.

FIG. 4 is a side view of internal trigger 3. Trigger protrusion 14 acts as a stop against pin 8 to prevent spring 6 from pushing internal trigger 3 too far forward. This particular configuration makes the proper operation of internal trigger 3 less sensitive to the effect of salt and sand deposits around stop pin 8 and protrusion 14 than if stop pin 8 and protrusion 14 were located closer to trigger pivot pin 5. The use of stop pin 8 instead of a cast bridge simplifies the manufacture of shackle casing 1.

Figure 5:
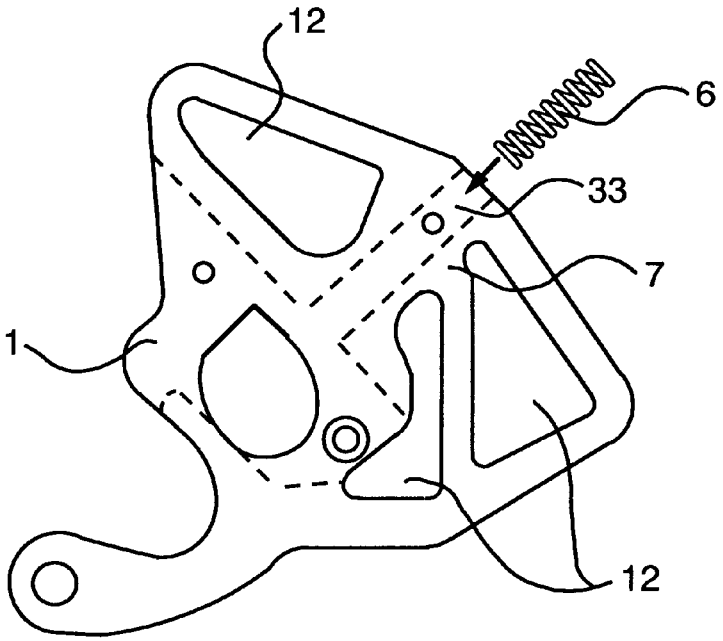
FIG. 5 is a side view of the shackle casing.
Figure 6:
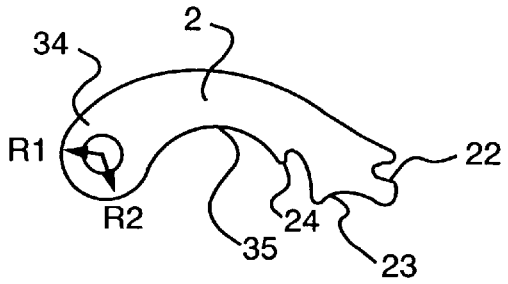
FIG. 6 is a side view of the shackle hook.
Figure 7:
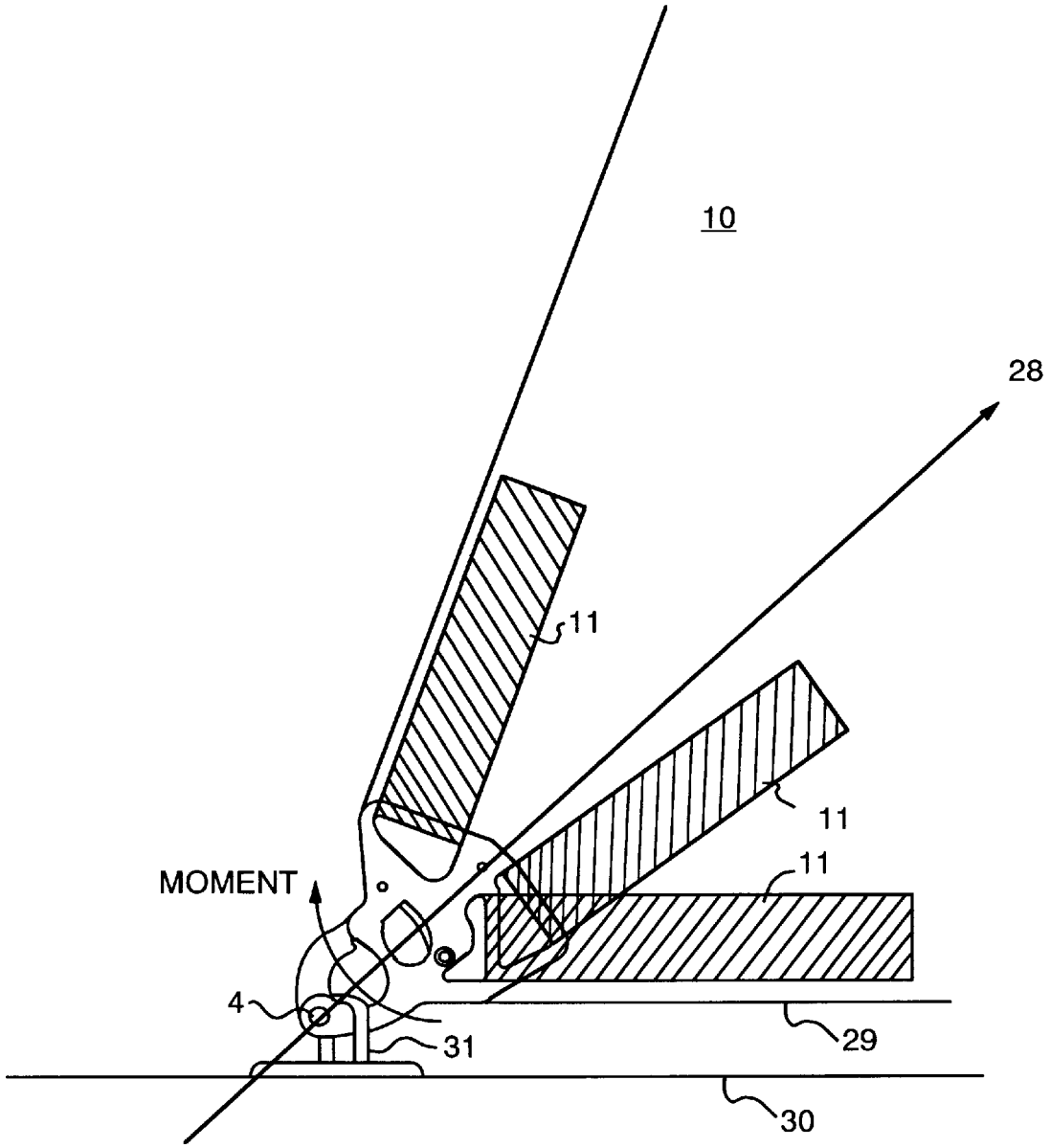
FIG. 7 is a side view of the shackle as attached to a sail, along with the forces and moments.

FIG. 5 is a side view of shackle apparatus 27 with hook 2 in an open position. Surface 22 is specifically designed in accordance with Tylaska's issued '233 patent. Protrusion 23 serves as a structural stop which deflects into shackle casing I under severe loadings and prevents hook 2 from deforming in such a manner that allows surface 22 to slide out from underneath surface 20. Determination of the curvature of surfaces 35 and 36 for rope or ring 25 to slide off instead of becoming snagged is provided by the inventor's previously issued '233 patent.

Protrusion 24 acts as a ramp causing rope or ring 25 to lift up out of the way before it hits or snags structural protrusion 23 when hook 2 opens under normal release. This allows for a more reliable operation.

Pivot end 34 is designed so that hook pivot pin 4 is located offset from the center 26. Centerline distance R1 of hook pivot end 34 is offset from true centerline R2 of hook 2. This offset pivot location allows pivot end 34 to rotate in a "cam" type action with respect to shackle casing 1 and thus allows rope or ring 25 to roll off shackle casing 1 using hook 2 as a bearing surface rather than merely sliding off. As hook 2 completely opens, the offset distance decreases until hook 2 and shackle casing 1 meet at a smooth transition.

The offset location of pin 4 also serves to improve the overall strength of shackle casing 1 as the material around the hole through hook 4 is thicker on its more highly stressed side. Hook pivot pin 4 is press fit through the shackle casing 1 while it is a loose fit through hook 2. Hook pivot pin 4 is sized so that its outside axial edges are flush with the sides of shackle casing 1 in order to minimize snagging.

Internal trigger 3 is attached to the shackle casing 1 by the use of trigger pivot pin 5. Trigger pivot pin 5 is press fitted through internal trigger 3, but is loose fit through shackle casing 1. This arrangement allows internal trigger 3 to rotate with respect to shackle casing 1. Trigger pivot pin 5 is sized so its axial edges are also flush with the sides of raised bosses 14. Raised boss area 14 increases the cross sectional area to improve tensile strength of casing 1 and to increase bearing contact area of trigger pivot pin 5.

Improved shackle apparatus 27 contains a spring 6 which is located in through hole 33 of shank 7. Hole 33 is drilled all the way through shank 7 in a longitudinal direction, and spring 6 is placed inside hole 33. Cross pin 9 serves to contain spring 6 inside the internal longitudinal hole through shank 7 and is press fit through shackle shank 7. Cross pin 9 is sized so that its axial edges are flush with respect to the sides of shank 7. Cross pin 9 is prereferably made smaller in diameter than the internal longitudinal hole through shank 7 so as to allow water to flush past cross pin 9 and flush out spring 6.

Figure 8:
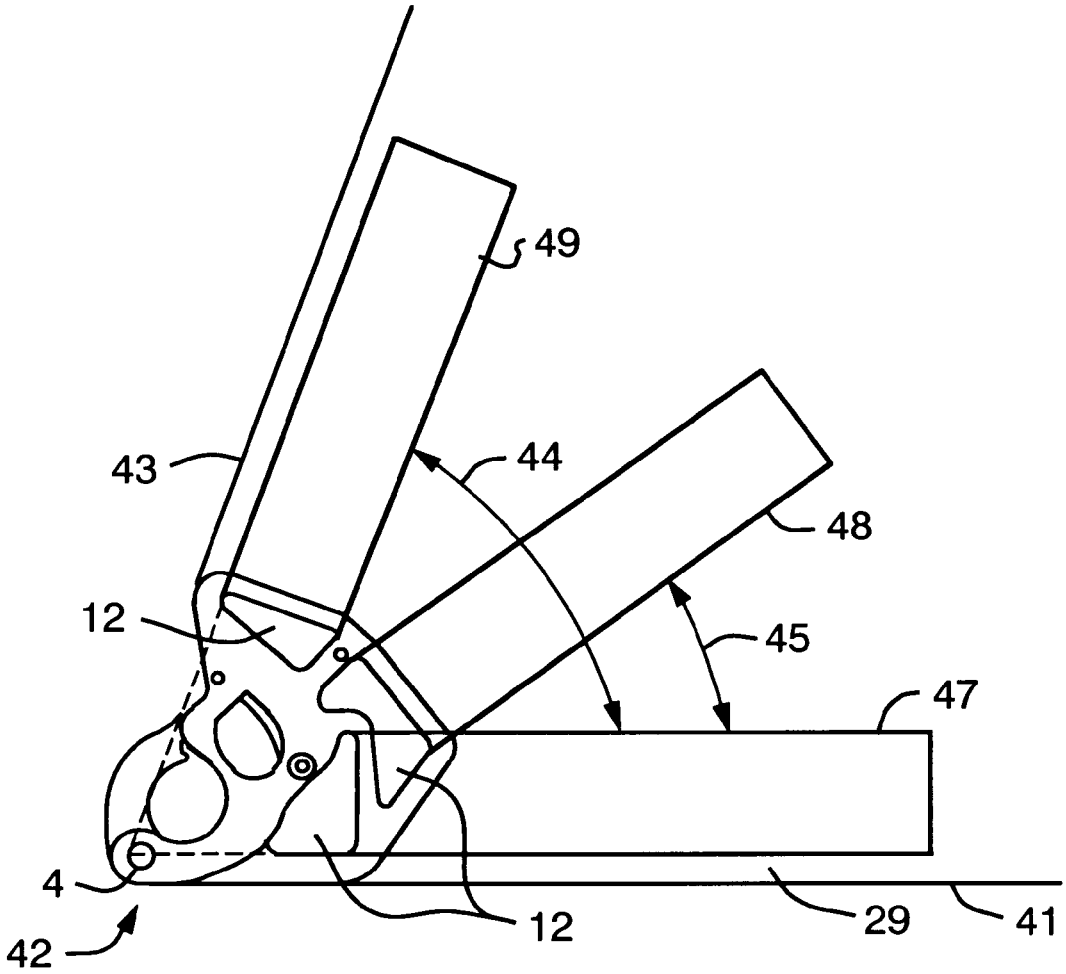
FIG. 8 is a side view of the shackle as attached to a sail using an alternative attachment position.

FIG. 8 is a side view of the shackle as attached to a sail using an alternative attachment position such that the shackle does not hang down below foot 29 of sail 10. As shown lugs 12 are positioned within sail 10 so that hook pivot pin 4 lies immediately adjacent to or at the projected comer 42 of sail 10. Projected corner 42 of sail 10 is defined by the intersection of edge 41 of foot 29 of sail 10 and edge 43 of luff 46 of sail 10. Bottom lug 12, that is, lug 12 nearest the foot 29 of sail 10, is oriented at zero degrees so that webbing 47 projects out substantially parallel to foot 29 of sail 10. Middle lug 12 is oriented at angle 45, which is preferably about 35 degrees. Upper lug 12 is oriented at angle 44, which is preferably about 70 so that webbing 49 is substantially parallel to luff 46 of sail 10.

While what has been described is considered at present to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A shackle which can be attached to the comer of a flexible membrane, said shackle comprising:

a shackle casing having a hook opening, a finger opening, and a trigger opening;

a hook having a pivotal end and a locking end with said pivotal end being pivotally connected within the hook opening of said shackle casing;

a hook pin within the pivotal end of said hook, said hook pin connecting said hook to said shackle casing, said hook pin defining a centerline;

a trigger, having a locking end and a pivotal end, said trigger being positioned within the finger opening with its pivotal end being pivotally connected within the trigger opening of said shackle casing;

a spring positioned within the shackle casing such that the spring opening communicates with the finger opening of said shackle casing;

a plurality of attachment members located around the perimeter of said shackle casing, wherein a flexible membrane can be attached thereto, and wherein said flexible membrane exerts a loading force on said attachment members;

a spring positioned within the said casing of said shank such that said spring is urged against said trigger; so that when a user urges the locking end of said hook against the locking end of said trigger, said spring is compressed allowing the locking end of said hook to engage the locking end of said trigger until said shackle locks in a closed condition; and so that when said user pulls on said trigger to compress said spring, the locking end of said hook is released from the locking end of said trigger to place said shackle in an open condition.

2. The shackle of claim 1 wherein said attachment members are positioned such that the loading force on each of said attachment members is substantially equal to one another.

3. The shackle of claim 1 wherein said attachment members are positioned such that a resultant force vector transmitted from the loading force produced by the flexible membrane is substantially coincident with the centerline of said hook pin.

4. The shackle of claim 1 wherein the flexible membrane is a sail for a boat having a deck, and wherein said attachment members are positioned so that said hook pin hangs below and outside of the foot of the sail, thereby preventing the sail from dragging across the boat deck.

5. The shackle of claim 4 wherein said attachment members are positioned such that said hook pin is located outside the attachment comer of the sail which eliminates the need for an unsupported strip of material along the edges of the sail.

6. The shackle of claim 4 wherein said attachment members have layout angle relative to one another such that any creases or wrinkles in the sail as a result of loadings created at the point of attachment are minimized.

7. The shackle of claim 4 wherein said attachment members have a layout geometry such that said shackle can be attached to the sail in the comer using attachment webbing that is substantially evenly distributed.

8. The shackle of claim 4 wherein said attachment members are rounded and contoured to reduce chafing and cutting of the supporting webbing.

9. The shackle of claim 1 further comprising:

a stop pin in said shackle casing;

a protrusion on the locking end of said trigger, such that when said protrusion contacts said stop, the forward movement of the said trigger is limited.

10. The shackle of claim 1 further comprising:

a first protrusion on the locking end of said hook, such that said first protrusion acts as a structural stop in the closed position when said first protrusion engages said shackle housing.

11. The shackle of claim 1 further comprising:

a second protrusion adjacent to the locking end of said hook, such that said second protrusion acts as a ramp to prevent a line from snagging said first protrusion.

12. The shackle of claim 1 wherein said hook having a pivotal center and wherein said hook pin is positioned offset to the pivotal center of said hook wherein said hook pivots in a "cam-like" manner with respect to said shackle casing.

13. The shackle of claim 1 wherein the flexible membrane is a sail with a projected corner for a boat having a deck, and wherein said attachment members are positioned such that said shackle lies substantially within the projected corner of the sail.

14. The shackle of claim 13 wherein said attachment members are positioned such that said hook pin is located at the projected corner of the sail.

15. The shackle of claim 13 wherein said attachment members have layout angle relative to one another such that any creases or wrinkles in the sail as a result of loadings created at the point of attachment are minimized.

16. The shackle of claim 13 wherein said attachment members have a layout geometry such that said shackle can be attached to the sail in the corner using attachment webbing that is substantially evenly distributed.

17. The shackle of claim 13 wherein said attachment members are rounded and contoured to reduce chafing and cutting of the supporting webbing.

* * * * *